US008136876B2

(12) United States Patent
Bellvis Castillo et al.

(10) Patent No.: US 8,136,876 B2
(45) Date of Patent: Mar. 20, 2012

(54) ERGONOMIC SUPPORTING/SITTING DEVICE

(75) Inventors: Juan Luis Bellvis Castillo, Saragossa (ES); JoséJavier Marín Zurdo, Saragossa (ES); Ricardo Ros Mar, Saragossa (ES)

(73) Assignee: Juan Luis Bellvis Castillo, Saragossa (ES)

( * ) Notice: Subject to any disclaimer, the term of this patent is extended or adjusted under 35 U.S.C. 154(b) by 63 days.

(21) Appl. No.: 12/601,381

(22) PCT Filed: Apr. 29, 2008

(86) PCT No.: PCT/ES2008/000291

§ 371 (c)(1), (2), (4) Date: Feb. 17, 2010

(87) PCT Pub. No.: WO2008/142179

PCT Pub. Date: Nov. 27, 2008

(65) Prior Publication Data

US 2010/0164259 A1 Jul. 1, 2010

(30) Foreign Application Priority Data

May 23, 2007 (ES) ..... 200701475

(51) Int. Cl.
*B62J 1/00* (2006.01)
*A61G 15/00* (2006.01)

(52) U.S. Cl. ..... 297/195.11; 297/313

(58) Field of Classification Search ..... 297/195.11, 297/258.1, 271.5, 451.5, 175, 461, 423.43, 297/4, 325, 310, 451.6, 313; D6/349; 135/84; 248/143, 371, 398

See application file for complete search history.

(56) References Cited

U.S. PATENT DOCUMENTS

| | | | | |
|---|---|---|---|---|
| 3,312,437 | A * | 4/1967 | Barth | 248/158 |
| 7,695,407 | B2 * | 4/2010 | Miller et al. | 482/51 |
| 2003/0164633 | A1 * | 9/2003 | Jakus et al. | 297/271.5 |
| 2007/0138850 | A1 * | 6/2007 | Oettinger | 297/271.5 |

FOREIGN PATENT DOCUMENTS

DE 3201335 A1 * 7/1983

* cited by examiner

*Primary Examiner* — Milton Nelson, Jr.

(74) *Attorney, Agent, or Firm* — Wenderoth, Lind & Ponack, L.L.P.

(57) ABSTRACT

Ergonomic supporting/sitting device useful on all those jobs which are performed while standing, being particularly useful for document sorting jobs and in operating rooms while performing surgery, including a base resting on the floor and a shaft for mounting a seat body such that this ergonomic device includes a base resting on the floor which has a flat back portion and a front portion curved convexly forward and toward both sides in relation to the supporting base surface resting on the floor.

2 Claims, 7 Drawing Sheets

ERGONOMIC SUPPORTING/SITTING DEVICE

FIELD OF THE INVENTION

As stated in the title of this specification, this invention relates to an ergonomic supporting/sitting device useful for all jobs performed while standing and also for those where one needs to change position, mainly from a standing to a seated or "seated standing" position, such as for document sorting work. This device is comprised of a supporting base and a shaft, adjustable in height, on which a seat body is mounted, the purpose thereof being for users to avail of a device allowing them to easily change from a standing to a "seated standing" position without any noticeable change in their position.

BACKGROUND OF THE INVENTION

As it is known, on certain jobs, such as document or product sorting, these workers progressively place the different documents or products into a specific working area, such as a shelf, and therefore stand in front thereof in order to access all of the sorting points or are continually changing position, going from a seated position, sitting on a conventional chair, to a standing position to then sit back down.

This is so given that in order to cover the entire work area, which is positioned at different distances from the worker, the worker must make solely forward movements and forward movements with slight sideways movements to either side.

Thus, the position changes are continual, and these changes usually entail abrupt movements and strained positions as a result of the effort which must be made by their legs and the strain on the middle back area on moving from a seated position to a standing position and back again.

Similarly, when remaining seated, movements are repeatedly made making it necessary for them to bend or twist their backs, sometimes beyond recommended limits.

Therefore, workers suffer from stress built up in their backs and legs throughout the workday, which gives rise to major fatigue and the onset of different physical problems.

Apart from the above, it is also known that surgeons stand in one place by the operating table without moving throughout an operation or surgical procedure.

Thus, surgical procedures, such as organ transplant operations, etc. entail a major degree of physical exhaustion and also psychological fatigue as a result of the stress they must withstand.

Thus, during surgical procedures, especially in the case of lengthy operations, on surgeons having to stand beside the operating table without moving, a major degree of stress builds up in their backs and legs.

US2003/0205924 discloses a gardening seat with an elongated convex base and is tapered towards the front for pivoting, and the base may include a flattered region located towards the rear of the post for stability. This document includes three embodiments, but all of them differ from the object of the present application.

GB865245 discloses a stool-like seat of hollow form intended for being used by a gardener, and said seat including an opening into the interior located between the knees, and having a rear flat portion and an adjoining upwardly-curved or arcuate front position, whereby the seat is adapted normally to rest upon its rear portion flat upon the ground in such a way that the gardener can sit in an upright position.

Hence, back and leg stress is caused as a result of standing up over long periods of time in one position.

SUMMARY OF THE INVENTION

The device presented may be for the purpose of facilitating the work of surgeons, given that it can be used during surgery operations, particularly during lengthy ones, so that a "seated standing" position can be adopted as an alternative to the usual standing position.

Thus, on making it possible to adopt a "seated standing" position from a standing position, the stress which builds up in the back and legs is thus relieved, therefore reducing the feeling of fatigue.

Similarly, in addition to affording the possibility of adopting a "seated standing" position by resting on this device, it may be used as a seat.

Therefore, users may avail of a supporting/sitting device allowing them to change position at will whenever they so desire on adopting a standing, seated or "seated standing" position.

This specification describes an ergonomic supporting/sitting device which is applicable to all those jobs normally performed while standing but which require moving forward and/or forward to the side.

Thus, it will be particularly applicable in document selection and/or sorting jobs, such as sorting mail onto shelves.

Similarly, it is also especially applicable in surgery rooms to be used by surgeons while performing surgery operations, even more so during lengthy operations.

Similarly, it is especially applicable on any job which is performed while standing.

For the purpose of providing a solution to the aforementioned drawbacks, a description is provided in this specification of an ergonomic supporting/sitting device for use in all those jobs which are performed while standing. Also on those requiring changing positions, mainly from a standing to a "seated standing" position, such as document sorting jobs, being based on a supporting base and a stand and seat body, the device thus being comprised of a supporting base resting on the floor to which a stand, adjustable in height, is attached, fitted with a sit/stand seat in a fixed position with limited tilting forward and forward sideways movement to both sides.

Thus, the aim is to avail of means, based on a new concept, making it possible to change from a standing to a "seated standing" position and not of a "seat" which remains in a seated position, although it may be used as such.

For the purpose of providing this device with limited forward tilting movement and forward movement to both sides, the supporting base on the floor has a flat back surface and a front surface curved convexly forward and toward both sides from its supporting surface resting on the floor, the shaft, adjustable in height, being one with the base.

Therefore, the base will be curved convexly forward and toward both sides, which will provide it with an approximate 15° forward tilting movement and an approximate 30° tilt toward each side, covering approximately a 60° angle.

Similarly, in one practical embodiment of the invention, the base will be curved convexly solely forward, providing it with a forward tilting movement.

Apart from the above, this supporting/sitting device has a protrusion at the center front and a slanted surface at its sides which ergonomically adapts to the slant of the users' thighs in their different positions, preventing weight from being concentrated on certain areas.

In short, the aim is to avail of an ergonomic device which will allow users to change mainly from their standing position to a "seated standing" position facilitating some rest and less stress on their legs and backs resulting from this minor position change without this change having any influence on the work being done.

To complete the description provided in following and for the purpose of aiding toward a better comprehension of the characteristics of the invention, a set of drawings is attached to this specification showing the most characteristic details of the invention for illustrative, non-limiting purposes.

DESCRIPTION OF A PREFERRED EMBODIMENT

Figure 2:
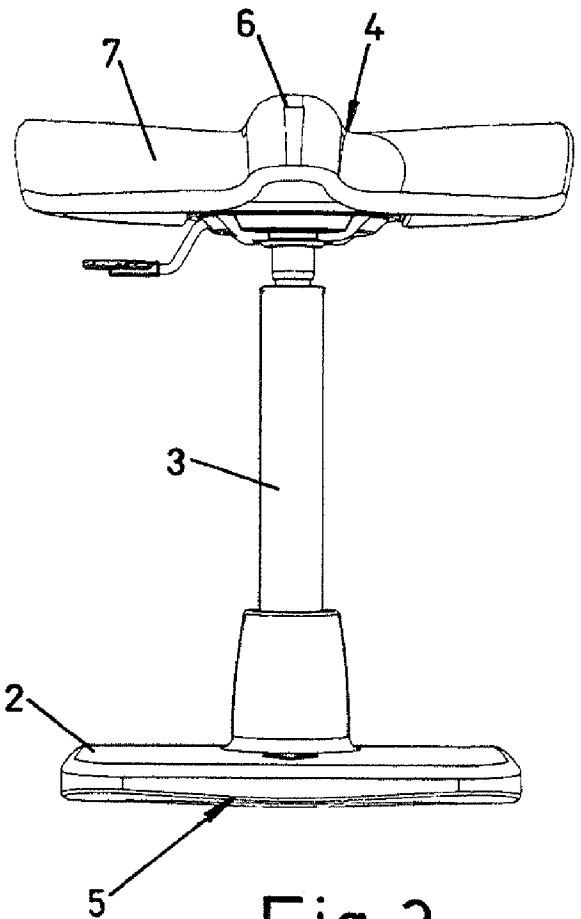
FIG. 2 provides a front view of the ergonomic supporting/sitting device showing how the front portion thereof is curved convexly forward and toward both sides.
Figure 1:
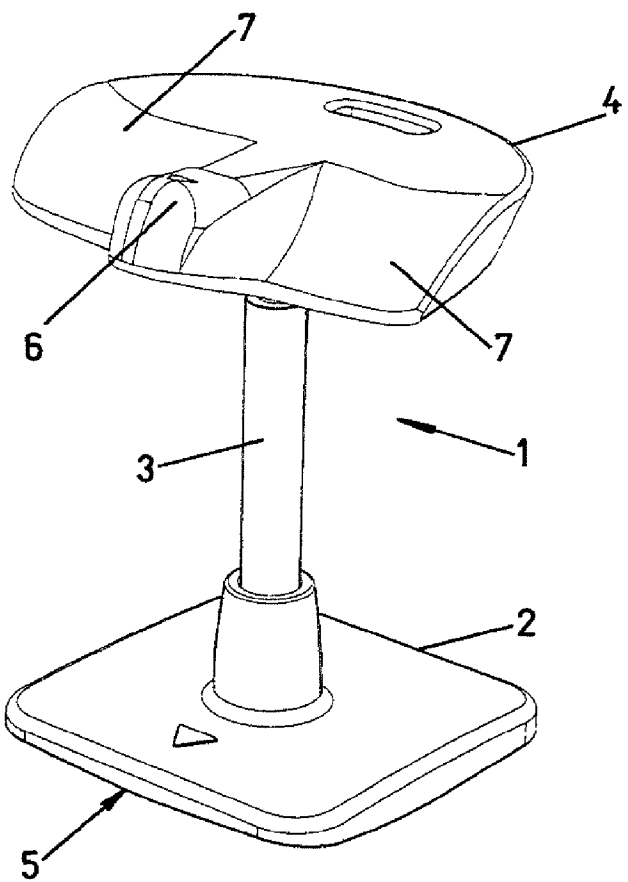
FIG. 1 provides a perspective view of an ergonomic supporting/sitting device showing how the front vertexes of the supporting base on the floor are curved upward.

In view of the figures discussed hereinabove and in keeping with the numbering adopted therein, it can be seen how the ergonomic supporting/sitting device (1) comprises a base (2) resting on the floor connected to a shaft (3), adjustable in height, equipped with a supporting/sitting body (4) for the purpose of the device having limited forward tilting movement such that the aim is a means, based on a new concept, of making it possible to adopt a "seated standing" position which is not a "seat" per se.

For the purpose of achieving the desired objective, in a preferred embodiment, the base (2) resting on the floor has a flat back portion and a front part (5) curved convexly forward or toward both sides as related to its base surface resting on the floor, the shaft (3), adjustable in height, being one with the base (2).

Therefore, in a preferred embodiment, the front portion (5) of the base (2) will be curved convexly forward, which will provide it with a limited forward tilting movement of approximately 15°, whilst the curved convexly to both sides will allow it to cover approximately a 60° angle, in other words, an approximate 30° angle to each side.

Figure 5:
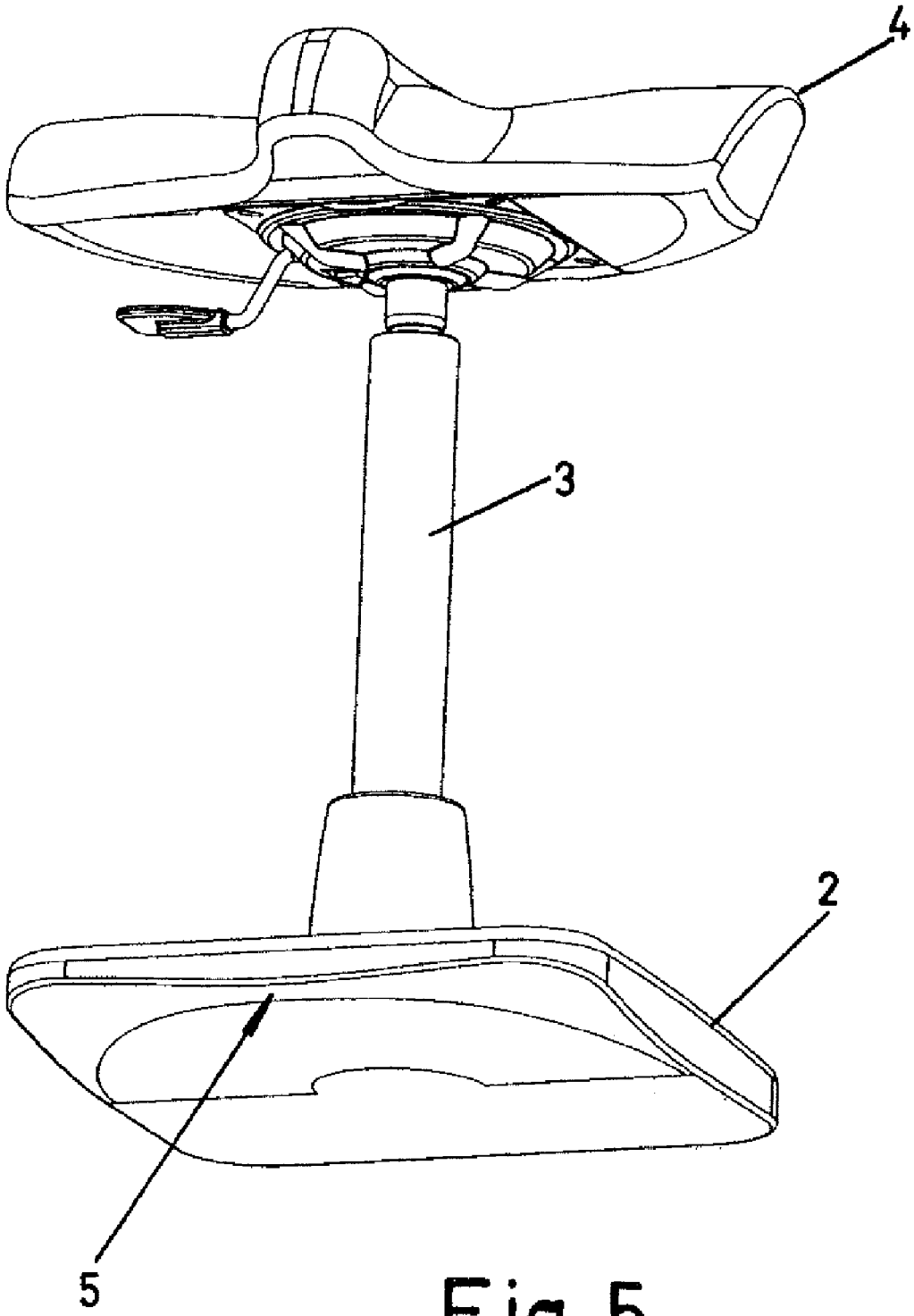
FIG. 5 provides a perspective view of the ergonomic supporting/sitting device, showing the characteristic curvature of the bottom of the base on its front portion, curved convexly forward and toward both sides.
Figure 7:
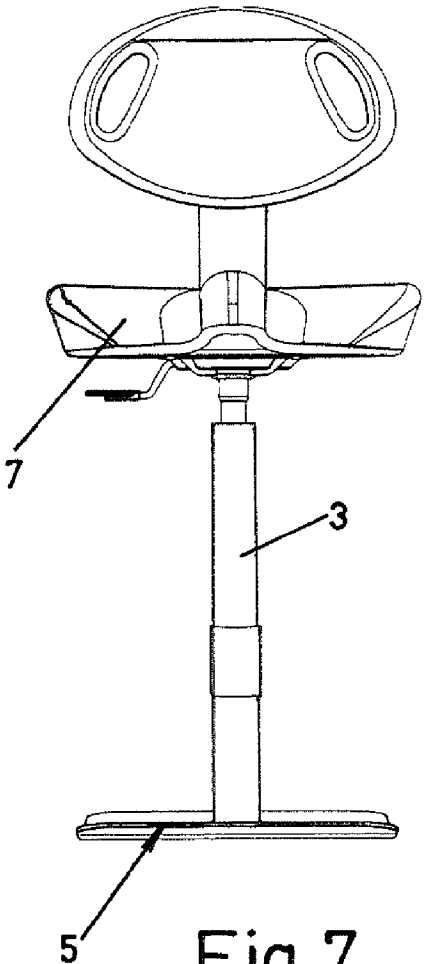
FIG. 7 provides a front view of the ergonomic supporting/sitting device of the immediately preceding figure hereinabove, showing the front portion thereof as being characteristically curved convexly forward.
Figure 6:
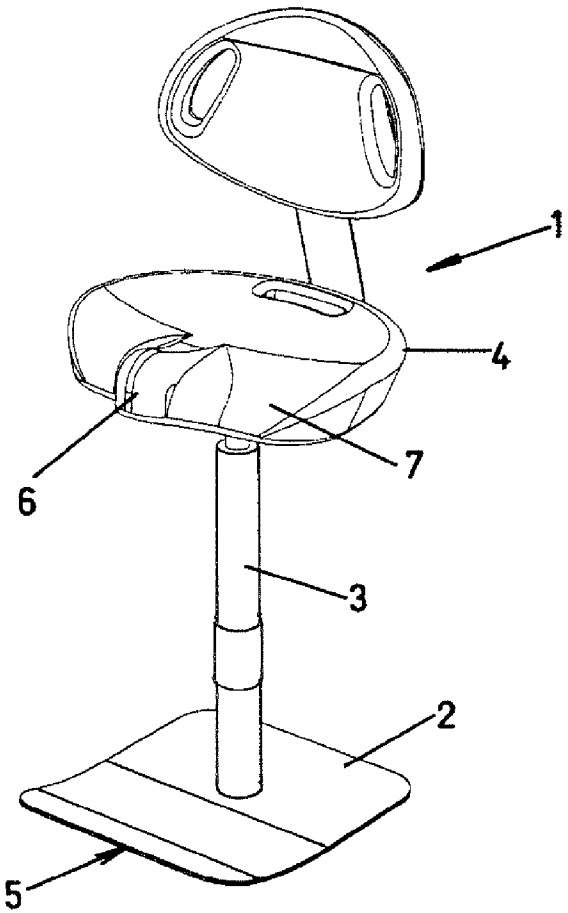
FIG. 6 provides a perspective view of one variation of embodiment of the ergonomic supporting/sitting device, in which the front portion of the base resting on the floor is curved convexly only forward.
Figure 9:
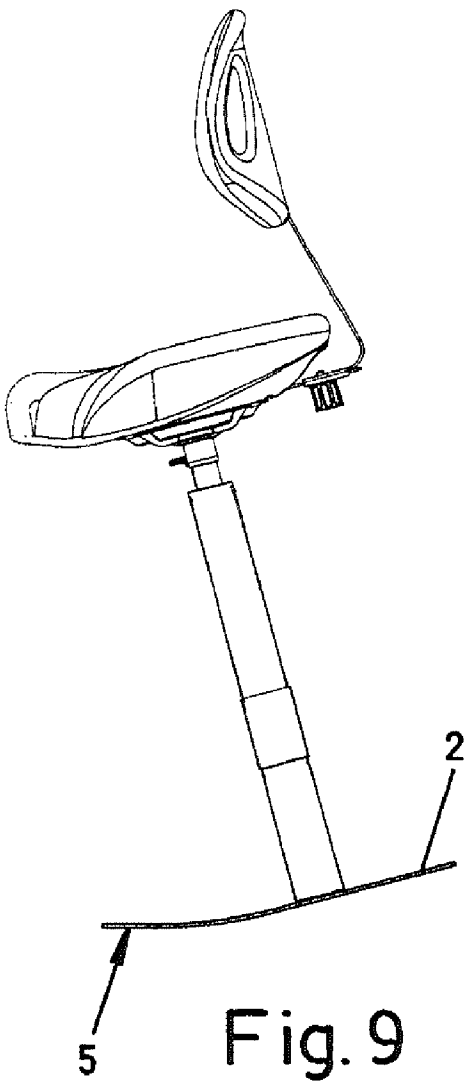
FIG. 9 provides a side elevation view of the ergonomic supporting/sitting device of the immediately preceding figure hereinabove resting on its convexly curved front part, showing the tilt adopted thereby.
Figure 8:
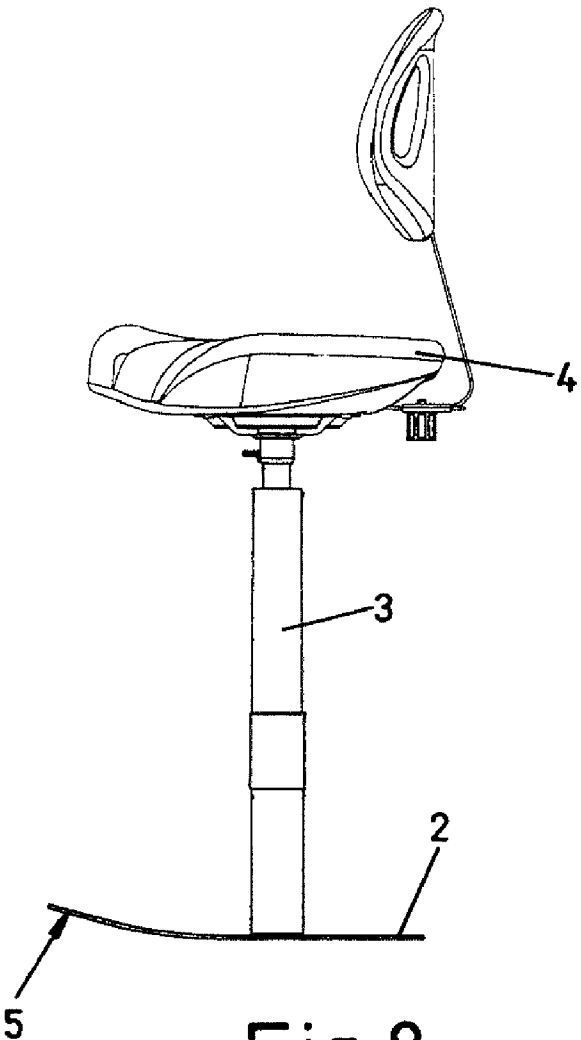
FIG. 8 provides a side elevation view of the ergonomic supporting/sitting device showing the curvature of the front part thereof.

Thus, FIG. 5 of the designs shows how the bottom of the base (2) has a flat portion at the back, whilst its front portion (5) is curved convexly forward and toward both sides, thus providing it with a forward and forward-sideways tilting movement.

Figure 4:
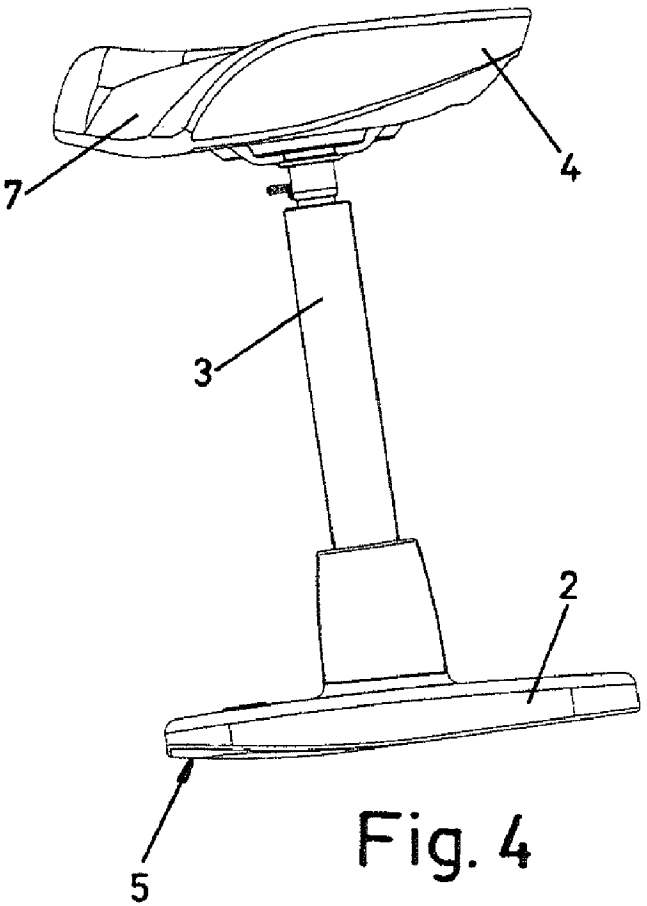
FIG. 4 provides a side elevation view of the ergonomic supporting/sitting device of the immediately preceding figure resting on the front portion thereof, showing the tilting position adopted thereby.
Figure 3:
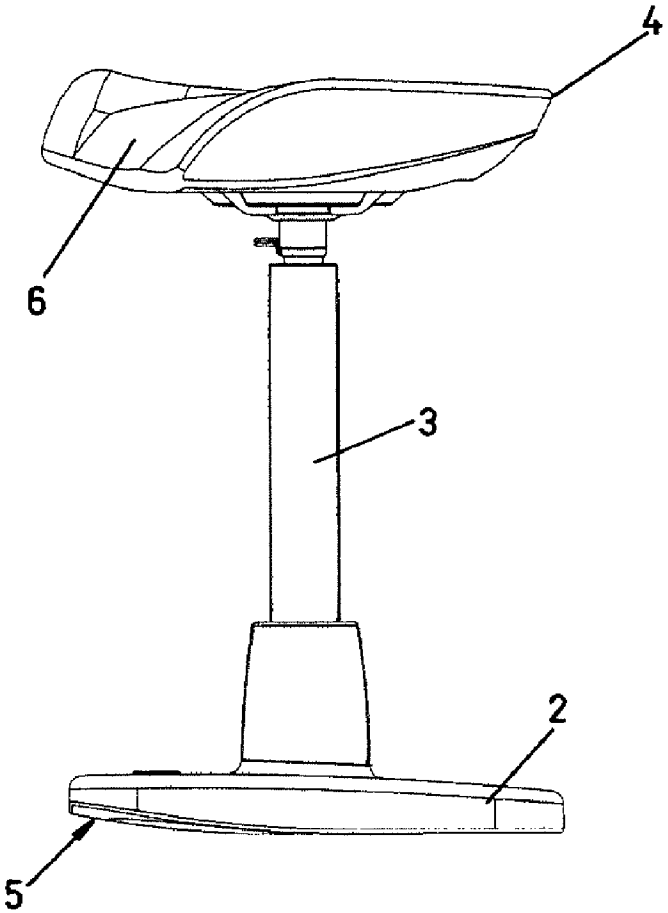
FIG. 3 provides a side elevation view of the ergonomic supporting/sitting device showing the curvature of the front portion thereof.

Apart from the above, FIG. 4 of the designs shows how the ergonomic supporting/sitting device has a slight forward tilting movement on being seated on the convexly-curved front portion (5) of the bottom of the base (2).

In one variation on the embodiment of the invention, the bottom of the base (2) can have its front portion (5) curved convexly solely forward, thus providing solely forward tilting movement.

FIGS. 6-9 of the designs show how the ergonomic supporting/sitting device has a base (2), the supporting bottom of which is convexly curved at its front portion (5), providing it with a forward tilting movement.

The base resting on the floor may logically be curved to different degrees with regard to its forward front and side portion for the purpose of providing it with different angles of incline.

Apart from the above, the central part of the front portion of user supporting/sitting body (4) has a protrusion (6) and the sides thereof have a large slanted area (7) which ergonomically adapts to the position users taken in their "seated standing" position, preventing their weight from being concentrated in certain areas.

In short, focusing on the use thereof in operating rooms, the aim is for the surgeon who is performing a surgical procedure to be able to move from a standing position to a "seated standing" position and back again in order to be able to shift from one position to the other thus reducing fatigue and stress, having a minor influence on the surgeon's working area.

Thus, the ergonomic supporting/sitting device (1) described is particularly useful during lengthy surgical procedures, such as organ transplant operations.

Similarly, the use of this ergonomic supporting/sitting device (1) on document sorting jobs provides some major advantages on making it easier for users to shift positions.

Similarly, it is particularly applicable to any type of work which is done while standing, making it easier for users to shift positions and reduce back and leg stress and fatigue.

Apart from the above, the forward and forward-sideways tilting movement can be achieved by equipping the shaft attached to the supporting/sitting body with a slight movement at the point where it is joined to the fixed base.

Thus, the tilting joint of the shaft to the base may be achieved by different conventional means, such as the turning stand being activated by a spring thrusting it into its vertical position by a knuckle joint, etc., thus providing a solution to the same technical problem by equivalent means, which does not entail any technical contribution whatsoever.

The ergonomic supporting/sitting device (1) logically may or may not be equipped a back, as well as with armrests or not, and may similarly be equipped with some means facilitating the its being picked up, such as an ergonomic opening made in the supporting/sitting body (4).

Figure 10:
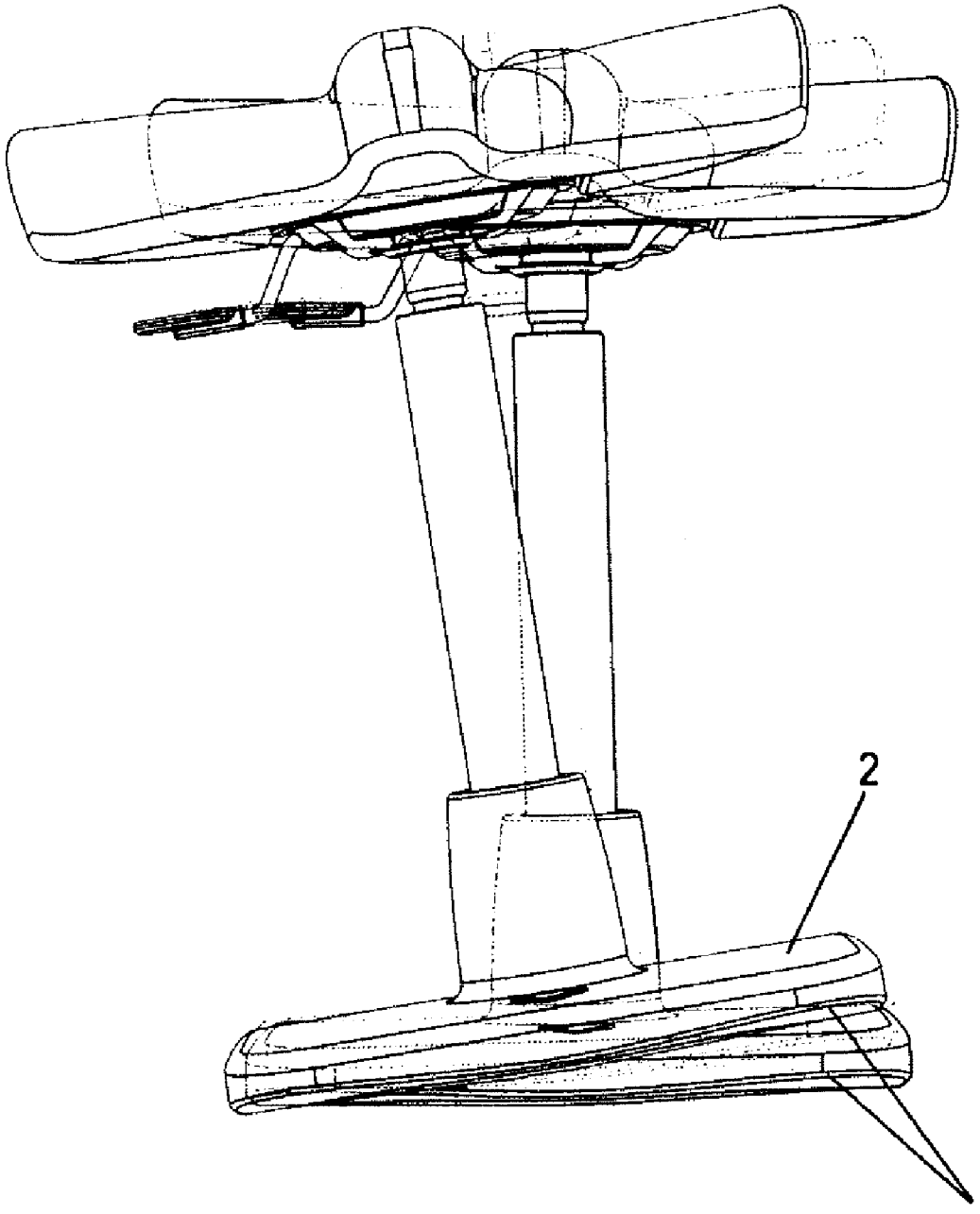
FIG. 10 provides a front view of the ergonomic supporting/sitting device, showing the lateral movement adopted thereby in keeping with the curved convexly of the front portion of both sides of the bottom of its base on the floor.

FIG. 10 of the designs shows how the ergonomic device has sideways movement in both directions, making it possible for users to cover a certain area in front of them, which can be assessed at an approximate 60° arc.

Figure 11:
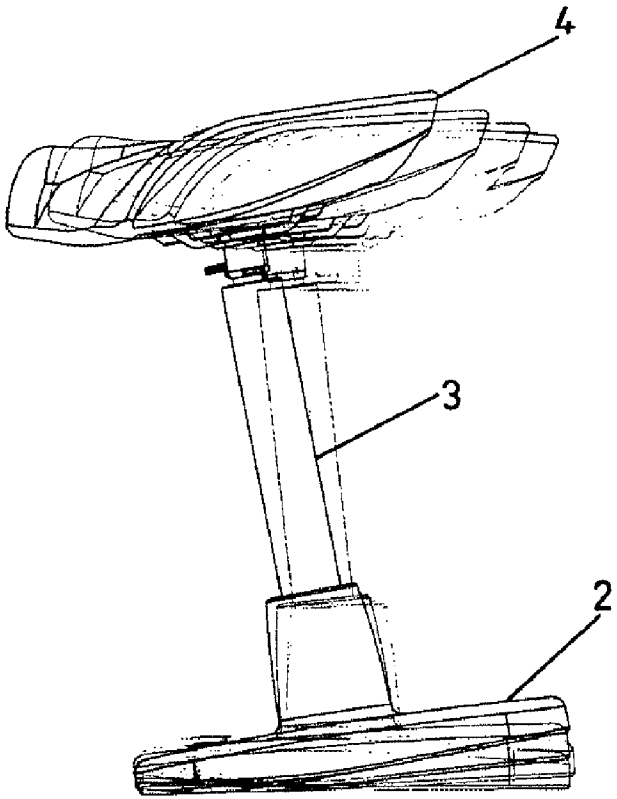
FIG. 11 provides a side view of the ergonomic supporting/sitting device, showing the forward movement adopted thereby in keeping with the forward curved convexly of the front of its base on the floor.

Similarly, FIG. 11 of the designs shows how the ergonomic device has a forward movement allowing users to move closer into their working area.

Figure 12:
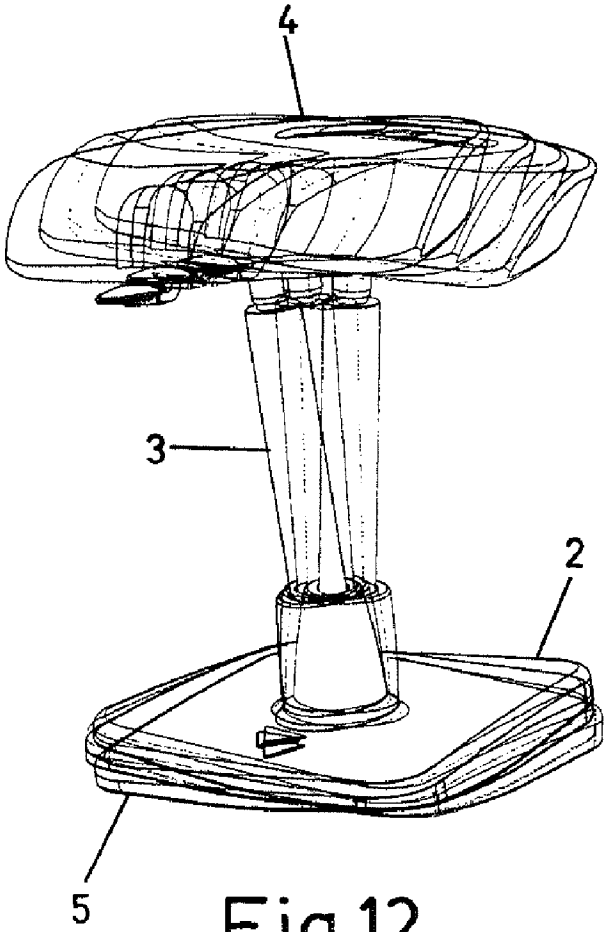
FIG. 12 provides a view of the ergonomic supporting/sitting device, showing the different movements it can make in keeping with the curved convexly forward and toward both sides of the front portion of the bottom of its base on the floor.

Lastly, FIG. 12 of the designs shows how the ergonomic device has lateral and forward movements allowing user to move closer into their working area in both a forward direction as well as forward and to either side.

The invention claimed is:

1. An ergonomic supporting/sitting device useful in document sorting jobs and in surgery rooms during surgical operations, comprising:

a straight base configured to rest on a floor; and a shaft with a supporting/sitting body, wherein the base configured to rest on the floor has a flat back portion and a front portion curved convexly forward and toward both sides of the front portion in relation to a surface configured to rest on the floor, the front portion convexly curved forward and toward the both sides of the front portion so as to provide a limited forward tilting movement of approximately 15°, and of approximately 30° toward each side of the both sides, and a seat is configured to be situated at a user's upper thigh level for support thereof, defining a supporting/sitting device.

2. An ergonomic supporting/sitting device according to claim 1, wherein the supporting/sitting body has a protrusion at the center of a front portion thereof and a slanted surface at sides thereof which is configured to ergonomically adapt to a slant of the user's upper thighs in different positions.

* * * * *